US005323943A

United States Patent [19]

Elledge

[11] Patent Number: 5,323,943

[45] Date of Patent: Jun. 28, 1994

[54] LAWN CHAIR CADDY APPARATUS

[76] Inventor: Donald G. Elledge, 2001 Oak Hollow Dr., Norman, Okla. 73071

[21] Appl. No.: 38,809

[22] Filed: Mar. 29, 1993

[51] Int. Cl.[5] ..... A45F 3/10

[52] U.S. Cl. ..... 224/265; 224/270

[58] Field of Search ..... 224/265, 266, 270, 272, 224/242, 201, 42.07, 42.03 B, 42.03 R

[56] References Cited

U.S. PATENT DOCUMENTS

| | | | |
|---|---|---|---|
| 823,058 | 6/1906 | Leavy | 224/201 |
| 1,370,768 | 3/1921 | Sperling | 224/201 |
| 1,969,199 | 8/1934 | Battles | 224/265 |
| 2,712,404 | 7/1955 | Miller | 224/270 X |
| 3,219,243 | 11/1965 | Mack | 224/270 X |
| 3,881,644 | 5/1975 | Demaline | 224/201 X |

*Primary Examiner*—Renee S. Luebke
*Attorney, Agent, or Firm*—E. Michael Combs

[57] ABSTRACT

Parallel support tubes mount first and second hook members at their upper distal ends for securement about an individual's shoulders, wherein a cross shaft extending orthogonally between the first and second tubes orthogonally and fixedly mounts a plurality of support tubes therefrom, wherein each of the support tubes includes a row of hooks, wherein adjacent hooks of each row of hooks are arranged to position a lawn chair for ease of transport and support of the lawn chairs.

4 Claims, 4 Drawing Sheets

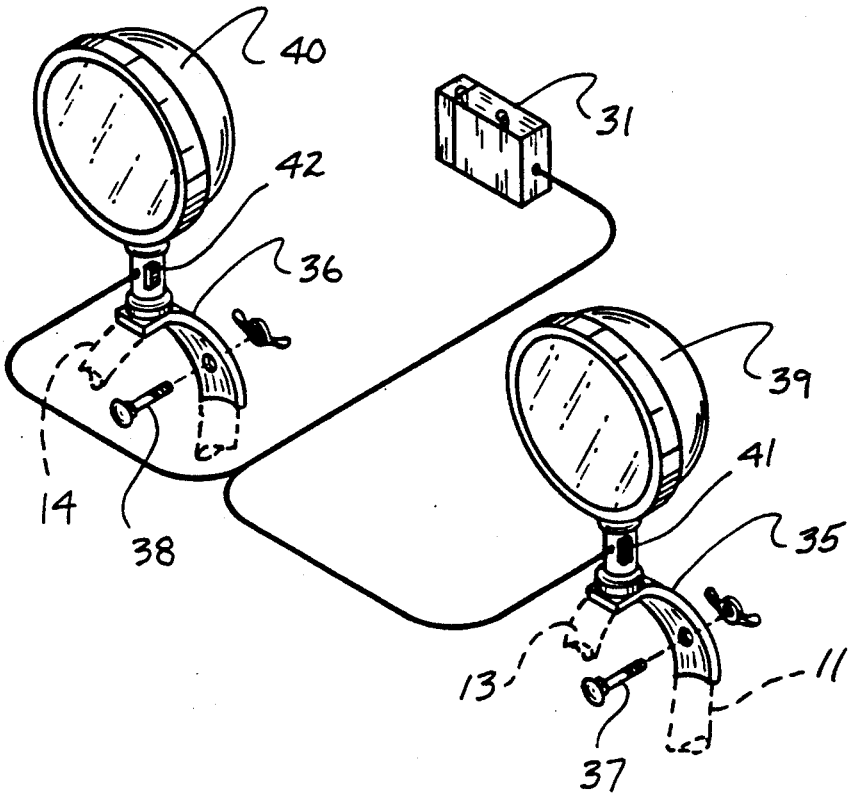
FIG. 7
FIG. 8
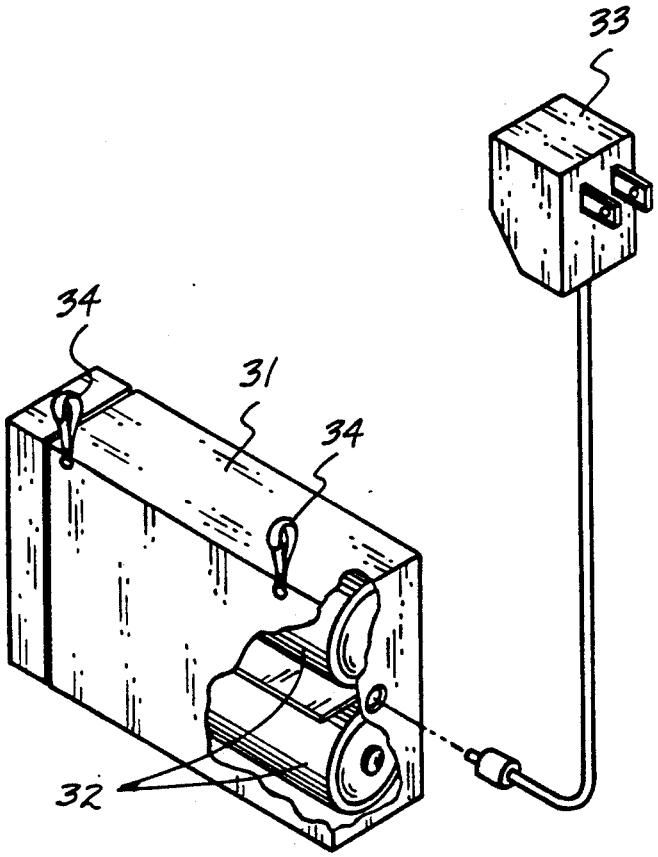

LAWN CHAIR CADDY APPARATUS

BACKGROUND OF THE INVENTION

1. Field of the Invention

The field of invention relates to backpack structure, and more particularly pertains to a new and improved lawn chair caddy apparatus wherein the same is directed to the transport of lawn chairs in an orderly row.

2. Description of the Prior Art

The movement and transport of lawn chairs by individuals is typically a cumbersome procedure as such lawn chairs are of a bulky construction and typically of a lightweight material, wherein the support of the lawn chairs is of greater significance than the transport of the weight associated with such lawn chairs. The prior art indicates the use of backpack structure that may be reconfigured into a chair construction, such as indicated in U.S. Pat. Nos. 4,487,345; 4,938,400; 4,533,151; and 3,997,213.

SUMMARY OF THE INVENTION

In view of disadvantages inherent in the known types of backpack apparatus now present in the prior art, the present invention provides a lawn chair caddy apparatus wherein the same is directed to the transport and positioning of a plurality of lawn chairs on a backpack structure. As such, the general purpose of the present invention, which will be described subsequently in greater detail, is to provide a new and improved lawn chair caddy apparatus which has all the advantages of the prior art backpack structure and none of the disadvantages.

To attain this, the present invention provides parallel support tubes mounting first and second hook members at their upper distal ends for securement about an individual's shoulders, wherein a cross shaft extending orthogonally between the first and second tubes orthogonally and fixedly mount a plurality of support tubes therefrom, wherein each of the support tubes includes a row of hooks, wherein adjacent hooks of each row of hooks are arranged to position a lawn chair for ease of transport and support of the lawn chairs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new and improved lawn chair caddy apparatus which may be easily and efficiently manufactured and marketed.

It is a further object of the present invention to provide a new and improved lawn chair caddy apparatus which is of a durable and reliable construction.

An even further object of the present invention is to provide a new and improved lawn chair caddy apparatus which is susceptible of a low cost of manufacture with regard to both materials and labor, and which accordingly is then susceptible of low prices of sale to the consuming public, thereby making such lawn chair caddy apparatus economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of illumination members arranged for optional employment by the invention.

FIG. 8 is an isometric enlarged view of the battery pack arranged in electrical communication with the illumination members of FIG. 7.

DESCRIPTION OF THE PREFERRED EMBODIMENT

Figure 1:
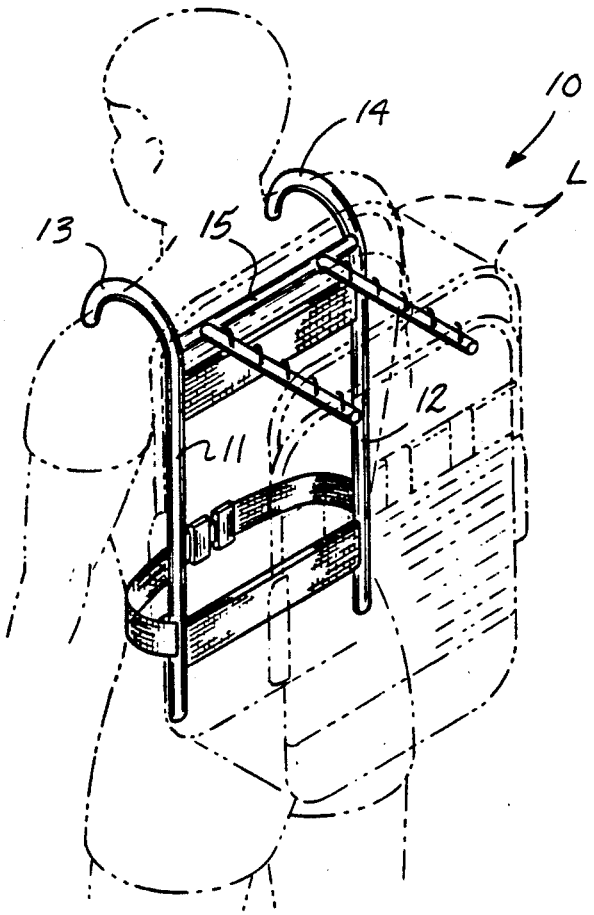
FIG. 1 is an isometric illustration of the invention in use.

With reference now to the drawings, and in particular to FIGS. 1 to 8 thereof, a new and improved lawn chair caddy apparatus embodying the principles and concepts of the present invention and generally designated by the reference numeral 10 will be described.

Figure 2:
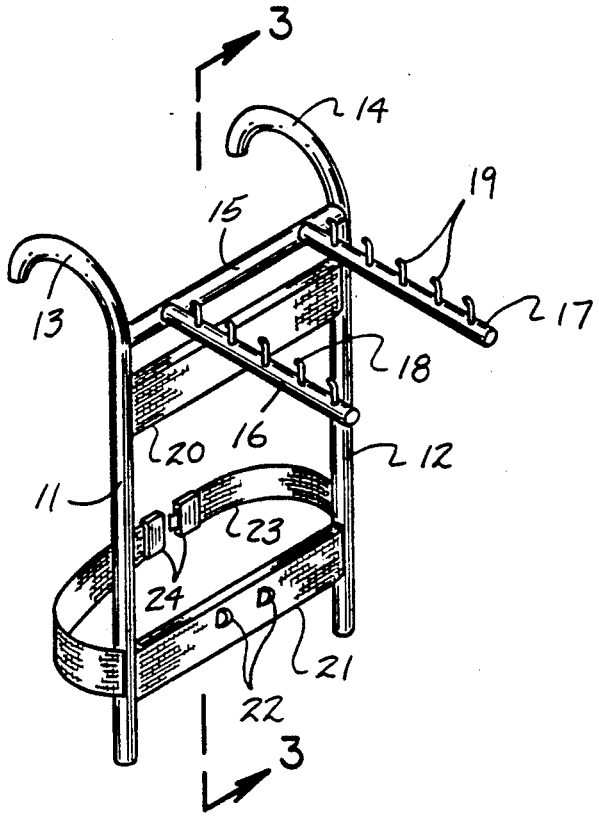
FIG. 2 is an isometric illustration of the caddy structure.
Figure 3:
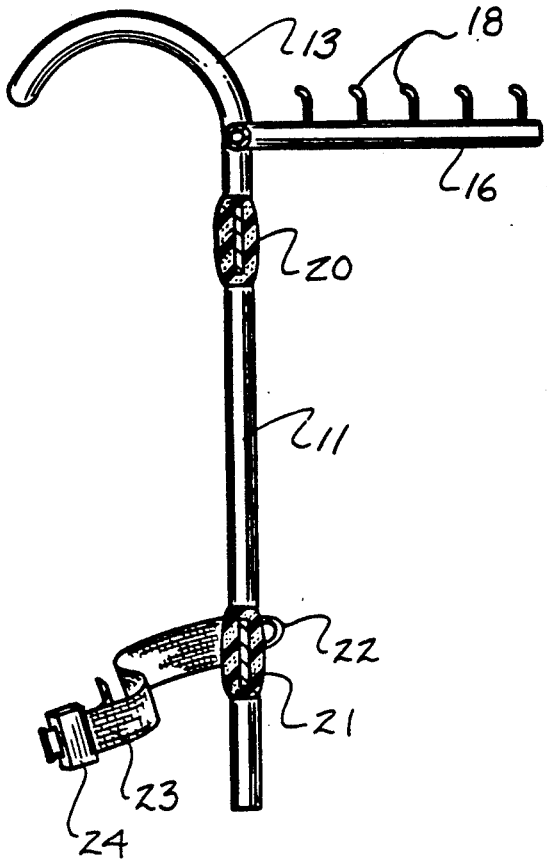
FIG. 3 is an orthographic view, taken along the lines 3—3 of FIG. 2 in the direction indicated by the arrows.
Figure 4:
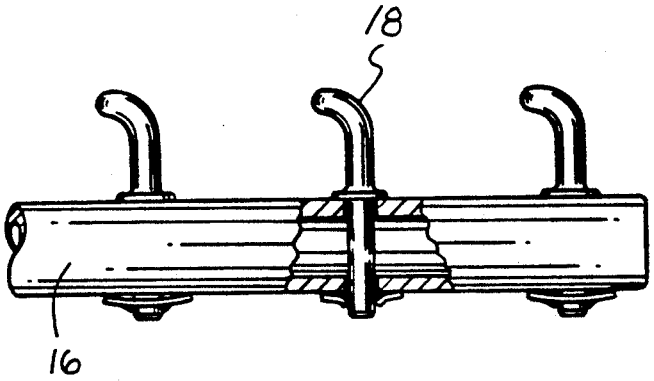
FIG. 4 is an enlarged orthographic view, partially in section, of construction of one of the support tube members.
Figure 5:
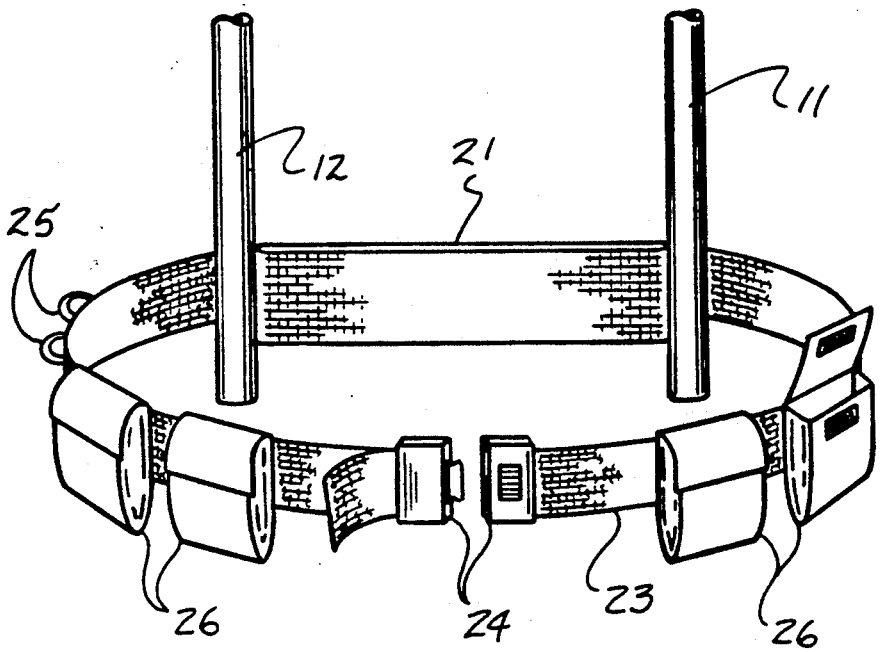
FIG. 5 is an isometric illustration of the belt member mounting a plurality of accessory pouches thereon.
Figure 6:
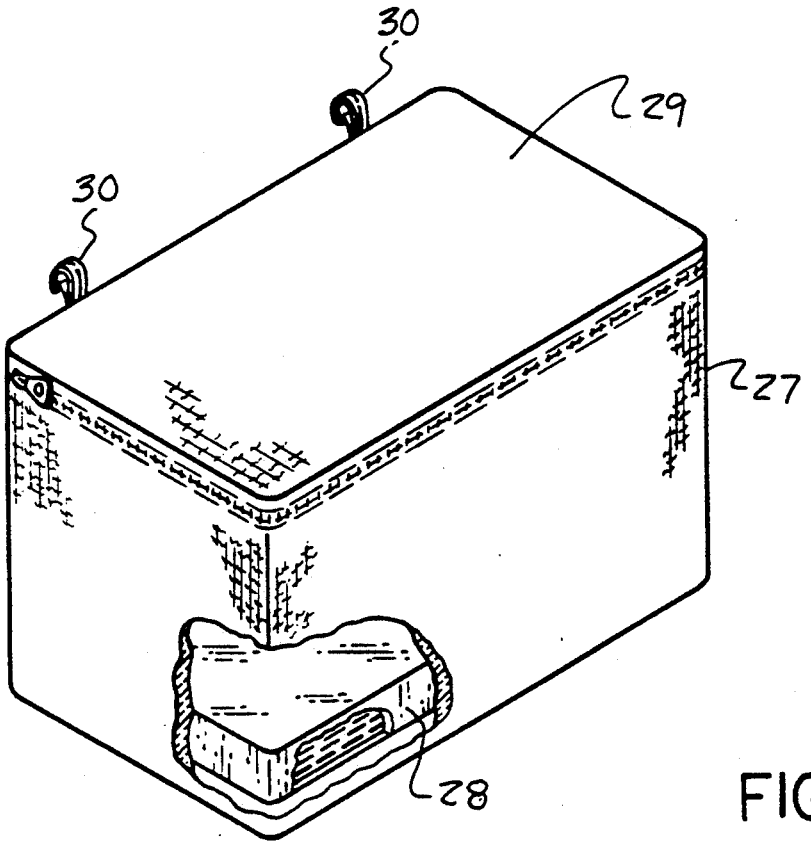
FIG. 6 is an isometric illustration of a cooler container arranged for transport optionally by the invention.

More specifically, the lawn chair caddy apparatus 10 of the instant invention essentially comprises a first support tube 11 spaced from, parallel to, and coextensive with a second support tube 12. The first support tube 11 includes a first tube hook member 13 mounted at an upper distal end of the first support tube, while the second support tube 12 includes a second tube hook member 14 mounted at an upper distal end of the second support tube, wherein the first and second hook members 13 and 14 are arranged in a parallel, coextensive orientation relative to one another, as indicated in FIG. 2 for example. A cross shaft 15 extends orthogonally between the first and second support tubes 11 and 12 in adjacency to the first and second hook members 13 and 14. First and second tube rows of hook projections 18 and 19 are mounted parallel relative to one another on the respective first and second mounting tubes 16 and 17, wherein each of the first hook projections 18 is aligned with one of the second hook projections 19 to secure a lawn chair L between a first and second hook projection 18 and 19 and the cross shaft 15. A first elastomeric brace 20 is oriented parallel to and in adjacency to the cross shaft 15, with a second elastomeric cross brace 21 mounted in adjacency and parallel the first cross brace 20 between the first cross brace and lower distal end of the first and second support tubes 11 and 12. The elastomeric cross braces 20 and 21, as indicated in FIG. 3 for example, include rigid metallic plate reinforcement pins and they are orthogonally and integrally mounted relative to the first and second support tubes 11 and 12 and extend between the first and second support tubes. A support belt 23 extends from the second cross brace 21, having a buckle 24 to secure the apparatus relative to an individual's torso portion, as indicated in FIG. 1, wherein a plurality of belt support loops 25 are mounted to the belt for transport of accessory organizations, wherein the second cross brace 21 includes second cross brace support loops 22 to permit securement for example of a cooler container 27 having a lid 29, with a refrigerant pack 28 therewithin, having container mounting hooks 30 for securement to the second cross brace support loops 22. Further, pouch members 26 are arranged for mounting to the belt 23 for optional transport of various components in association with an outdoor activity.

The FIGS. 7 and 8 indicate the use of first and second spotlight assemblies 39 and 40, having respective first and second switches 41 and 42 for electrical communication with a battery container 31. The battery container 31, as indicated in FIG. 8, includes a plurality of battery members 32 therewithin, having a recharge assembly 33 optionally employed with the batteries. Battery container hooks 34 mounted to the container 31 are arranged for securement to the belt support loops 25, wherein the battery container 31 is in electrical communication with the spotlight assemblies 39 and 40, wherein the first spotlight assembly 39 includes a first arcuate hook member mounting plate 35 having a first fastener 37 for securing the first hook member mounting plate 35 to the first hook member 13. Similarly, a second arcuate hook member mounting plate 36 employing a second fastener 38 is arranged for securement to an exterior surface of the second hook member 14. In this manner, use of the invention during conditions of limited available light is available to an individual, and wherein the spotlight structure may be removed and stored during periods of non-use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lawn chair caddy apparatus, comprising, a first support tube and a second support tube, with the first support tube and the second support tube arranged in a parallel, coextensive relationship, with the first support tube having a first tube upper distal end, and the second support tube having a second tube upper distal end and a second hook member mounted to the second tube upper distal end, with the first hook member and second hook member arranged in a parallel, coextensive relationship relative to one another, and a cross shaft orthogonally and fixedly mounted between the first support tube and the second support tube in adjacency to the first hook member and the second hook member, and a first mounting tube fixedly and orthogonally mounted to the cross shaft in adjacency to the first support tube, and a second mounting tube fixedly and orthogonally mounted to the cross shaft in adjacency to the second support tube, wherein the first mounting tube and the second mounting tube are arranged in a parallel, coextensive relationship, and the first mounting tube including a row of spaced first hook projections, the second mounting tube including a row of second spaced tube second hook projections, wherein each of said first hook projections is positioned adjacent relative to one of said second hook projections to define a pair of hook projections, wherein each said pair of hook projections are arranged to position a lawn chair member between the pair of hook projections and the cross shaft.

2. An apparatus as set forth in claim 1 including an elastomeric cross brace orthogonally and fixedly mounted between the first support tube and the second support tube, wherein the elastomeric cross brace includes a support belt extending from the elastomeric cross brace, and the support belt includes a plurality of pouch members mounted to the support belt, and the support belt includes a plurality of belt support loops.

3. An apparatus as set forth in claim 2 including a battery container, the battery container having a plurality of batteries therewithin, and the battery container including a plurality of battery container hooks, wherein each of the battery container hooks is arranged for securement to one of the belt support loops, and a first spotlight assembly and a second spotlight assembly, the first spotlight assembly including a first switch, the second spotlight assembly including a second switch, and a first arcuate hook member mounting plate integrally secured to the first spotlight assembly, and a second arcuate hook member mounting plate integrally secured to the second spotlight assembly, wherein the first arcuate hook member mounting plate includes a first fastener directed through the first hook member for securing the first arcuate hook member mounting plate to the first hook member, and a second fastener is directed through the second hook member fixedly securing the second arcuate hook member mounting plate to the second hook member.

4. An apparatus as set forth in claim 3 including a cooler container having a lid and a plurality of container mounting hooks, wherein the elastomeric cross brace includes a plurality of elastomeric cross brace support loops, and the container mounting hooks are arranged for securement to the cross brace support loops.

* * * * *